US006431798B1

(12) United States Patent
Magliocco

(10) Patent No.: US 6,431,798 B1
(45) Date of Patent: Aug. 13, 2002

(54) CONFIGURABLE BLOCK FOR RETAINING WALL

(75) Inventor: Richard L. Magliocco, Pewaukee, WI (US)

(73) Assignee: Best Block Company, Milwaukee, WI (US)

( * ) Notice: Subject to any disclaimer, the term of this patent is extended or adjusted under 35 U.S.C. 154(b) by 0 days.

(21) Appl. No.: 09/843,447

(22) Filed: Apr. 26, 2001

(51) Int. Cl.[7] ..... E02D 29/02; E04C 1/00

(52) U.S. Cl. ..... 405/286; 405/284; 52/98; 52/169.3; 52/169.4

(58) Field of Search ..... 405/272, 284, 405/286; 52/98–100, 169.1–169.4, 574, 575, 608, 609

(56) References Cited

U.S. PATENT DOCUMENTS 5,078,940 A 1/1992 Sayles ..... 264/154
5,217,630 A 6/1993 Sayles ..... 249/52
6,024,517 A 2/2000 Castonguay et al. ..... 405/286
6,082,057 A * 7/2000 Sievert ..... 52/100
6,149,352 A 11/2000 MacDonald ..... 405/284
6,178,715 B1 * 1/2001 Pacitto et al. ..... 405/264

* cited by examiner

*Primary Examiner*—Thomas B. Will
*Assistant Examiner*—Tara L. Mayo
(74) *Attorney, Agent, or Firm*—Andrus, Sceales, Starke & Sawall, LLP

(57) ABSTRACT

A retaining wall block that includes three textured outer face surfaces and can be divided into a pair of sub-blocks of different sizes that are configured to be compatible with each other for use in the construction of a retaining wall having a random appearance. The retaining wall block has three textured outer face surfaces of varying lengths and when the retaining wall block is separated into its sub-blocks, each of the sub-blocks define two additional textured face surfaces of different lengths. The main retaining wall block is capable of creating individual wall blocks having one of six different face surface lengths.

12 Claims, 3 Drawing Sheets

CONFIGURABLE BLOCK FOR RETAINING WALL

BACKGROUND OF THE INVENTION

The present invention generally relates to retaining wall blocks and retaining walls constructed from such blocks. More specifically, the present invention relates to a retaining wall block that can be used as whole unit or subdivided into a pair of mating sub-blocks such that the block can be configured to present one of five individual outer faces, thereby permitting the construction of walls having a random natural appearance with varying block face sizes to create the appearance of a natural stone wall.

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

In recent years, segmental concrete retaining wall units, which include dry stacked individual blocks, have become widely accepted in the construction of retaining walls. These type of retaining walls are structurally sound, easy and relatively inexpensive to install, and couple the durability of concrete with the attractiveness of various architectural finishes available for the concrete blocks.

Currently, many commercially available blocks are symmetrical and include parallel front and back faces and non-parallel, converging side surfaces. The converging side surfaces allow the blocks to be stacked and form a curvilinear pattern for the retaining wall.

Another important feature of retaining wall blocks is the appearance of the block. One method to make naturally appearing blocks has been described in U.S. Pat. Nos. 5,078,940 and 5,217,630 (both to Sayles). These patents describe a method and apparatus for manufacturing a concrete block having an irregular face surface. The irregular surface can be made to look similar to split stone, and is thus very desirable. The split stone face surface is created by pouring uncured block material into a mold cavity and causing a portion of the material to be retained within the mold as the block is removed from the cavity. The severing of the outer face surface of the block as it is removed from the mold creates the desired appearance without requiring the conventional splitting operation.

Typically, retaining wall blocks are manufactured to have a split face on only the front face of the block. Such blocks do not allow the user the option to use either the front, side or back face of the block interchangeably as the exposed front face.

In addition to utilizing the split face of a block, another highly desirable technique in forming a retaining wall is to create a random, or ashier, pattern along the face of the retaining wall. The random pattern gives the appearance of a mortared or dry-stacked natural stone wall, which is a traditional and well recognized look. The creation of a truly random appearance requires the production of multiple block shapes for use in a single retaining wall. The use of multiple block shapes is inefficient from a production standpoint because this requires multiple molds and additional types of blocks to inventory. If only one face of the block is intended to be the front face, then the block system will suffer a tradeoff between having enough face sizes to create a random, natural appearance and the cost of using multiple molds in creating multiple inventory items.

In addition, when utilizing blocks of various sizes to create a random look on a retaining wall, it is important that the block sizes are multiples of each other such that proper stacking of rows of individual blocks can be carried out to ensure the structural stability of the retaining wall.

Therefore, it would be desirable to produce a retaining wall block having multiple face surfaces that can be used to create a retaining wall having a random shape. Further, it would be desirable to provide a single individual block that can be subdivided into a pair of individual blocks to increase the number of face surfaces without requiring the use of additional molds and creating multiple inventory items. Further, it would be desirable to create a single block having a scoring groove that will allow for splitting of the single block into a pair of mating sub-blocks.

SUMMARY OF THE INVENTION

The present invention is a retaining wall block that can be utilized to form a retaining wall having a random appearance. The retaining wall block of the present invention includes a first textured face surface and a second textured face surface that are parallel to each other and spaced apart by the width of the block. Preferably, the length of the first textured face surface is less than the length of the second textured face surface, such that the first and second textured face surfaces can be utilized to create different length face surfaces for the retaining wall.

The retaining wall block further includes a third textured face surface that defines one side of the retaining wall block. The length of the third textured face surface is less than both the first and second textured face surfaces, such that the third textured face surface creates another length face surface for the retaining wall. The textured faces of the retaining wall block can be formed by either hard split or soft split methods.

The retaining wall block includes a scoring groove extending between the first and second textured face surfaces. The scoring groove allows the retaining wall block to be divided into a first sub-block and a second sub-block. When the retaining wall block is divided into the first sub-block and the second sub-block, the first textured face surface is divided into a fourth face surface contained on the first sub-block and a fifth face surface contained on the second sub-block. Likewise, the second face surface is divided into a sixth face surface contained on the first sub-block and a seventh face surface contained on the second sub-block. In accordance with the present invention, the wall block can be configured to define seven distinct face surfaces, six of which have a different length, such that the sub-blocks and the main block can be used to create a random pattern in a retaining wall.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
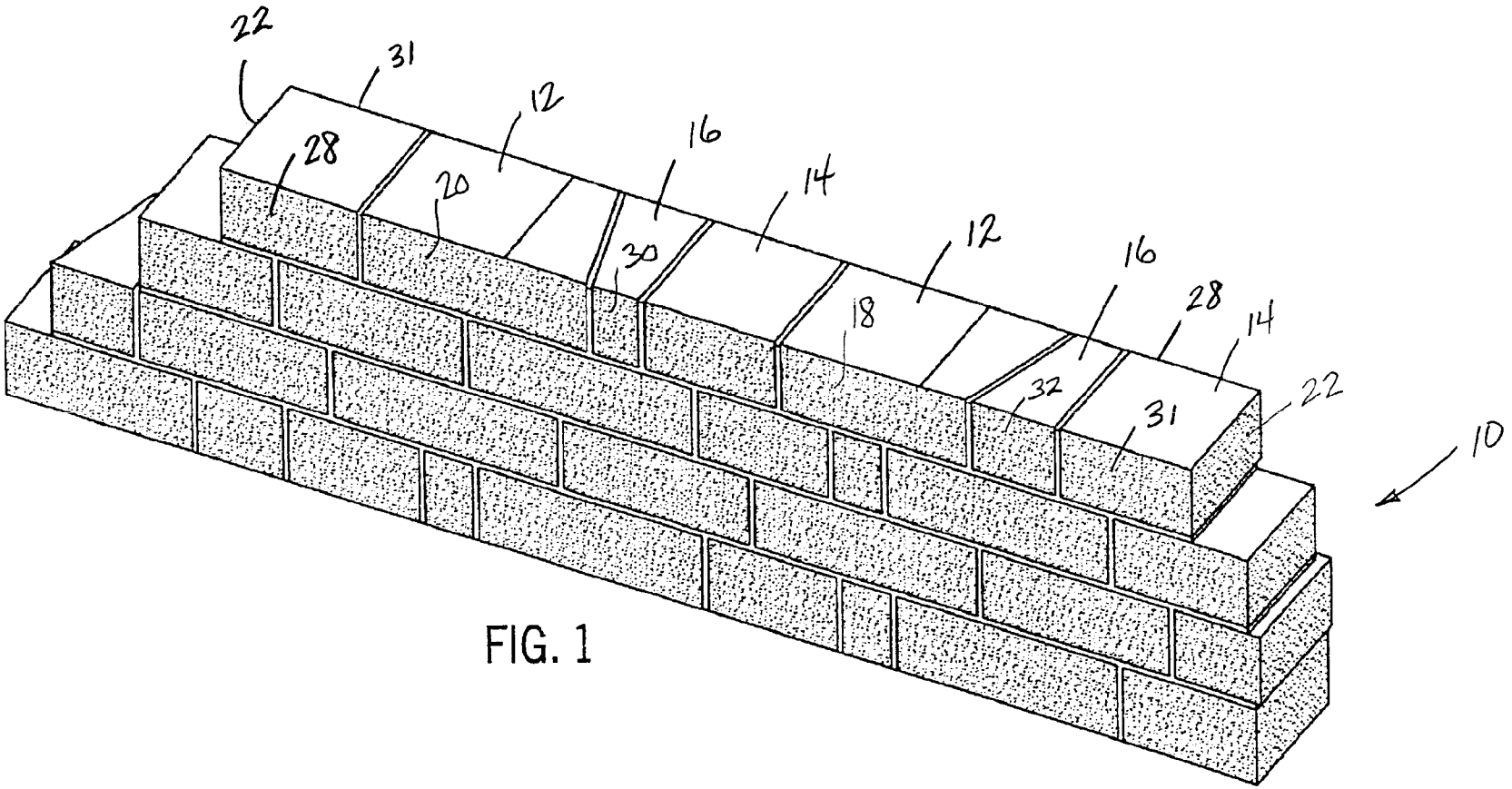
FIG. 1 is a perspective view of a retaining wall formed from a concrete block constructed in accordance with the present invention.

Referring first to FIG. 1, thereshown is a retaining wall 10 constructed utilizing the retaining wall blocks of the present invention. As illustrated in FIG. 1, the retaining wall 10 appears to be formed from a random selection of blocks each having different lengths of the front face surface that is viewed by an observer. As will be described in detail below, the retaining wall 10 is formed from a complete retaining wall block 12, a first sub-block 14 and a second sub-block 16. As can be seen in FIG. 1, the complete retaining wall block 12, the first sub-block 14 and the second sub-block 16 can be positioned in two different orientations to create different lengths of visible face surface.

Figure 2:
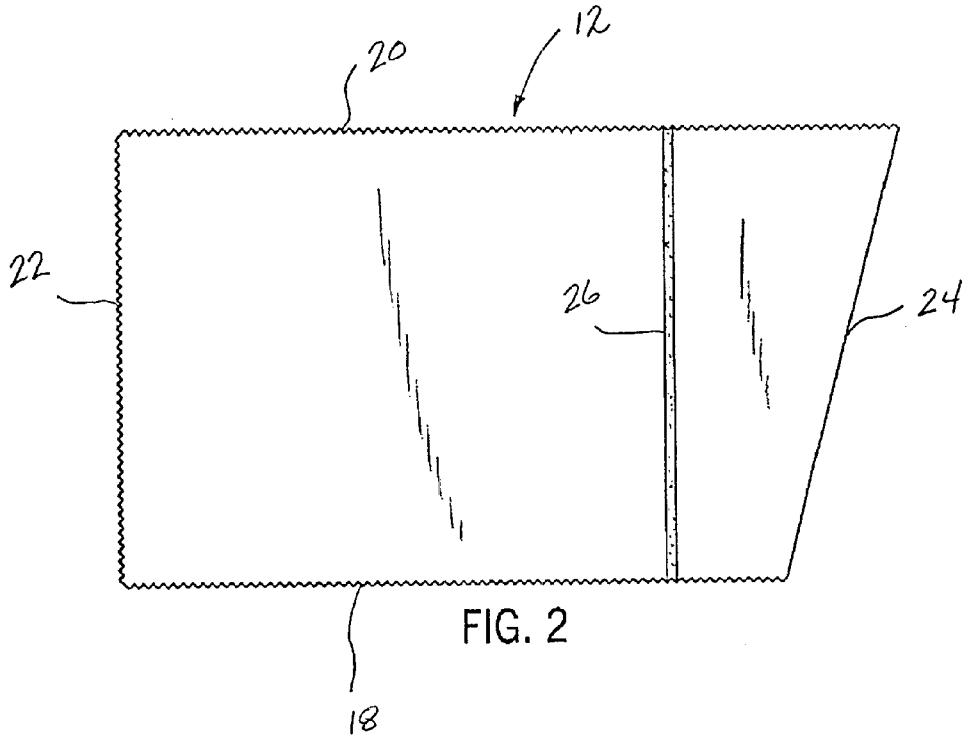
FIG. 2 is a top view of the retaining wall block according to the present invention.

Referring now to FIG. 2, thereshown is the retaining wall block 12 of the present invention. The retaining wall block 12 is preferably a solid concrete block having a thickness of approximately three inches, although other thicknesses are contemplated as being within the scope of the present invention. The wall block 12 is defined by a first textured face surface 18, a second textured face surface 20, a third textured face surface 22 and an angled side surface 24.

In the preferred embodiment of the invention, the first textured face surface 18, the second textured face surface 20 and the third textured face surface 22 include an irregular surface, such as is manufactured in accordance with the method described in U.S. Pat. Nos. 5,078,940 and 5,217,630, each of which are incorporated herein by reference. Alternatively, the textured face surfaces can be formed by using conventional hard split methods or the block 12 can be tumbled or processed to form the textured face surfaces.

The textured surface on each of these three surfaces of the retaining wall block 12 creates a desirable and pleasing appearance for the block 12. In the preferred embodiment of the invention, the length of the first face surface 18 is less than the length of the second face surface 20, and both the first and second face surfaces are longer than the third face surface 22. Preferably, the first face surface 18 has a length of 10.75 inches. The second face surface 20 preferably has a length of 12.75 inches, and the length of the third face surface is preferably 7.5 inches.

As can be understood in FIG. 1, the retaining wall block 12 can be used to form the retaining wall in either a first position, in which the first textured face surface 18 faces outward, or a second position in which the second face surface 20 faces outward. Thus, the complete retaining wall block 12 can be used to create two distinct outwardly facing surfaces 18 and 20 for use in constructing the retaining wall 10.

Referring back to FIG. 2, the top surface of the retaining wall block 12 includes a scoring groove 26. The scoring groove 26 is a recessed groove formed in the top surface of the retaining wall block 12 and facilitates fracture of the block 12 along the scoring groove 26 in order to form two individual, distinct sub-blocks. Preferably, the retaining wall block 12 can be separated into its two sub-blocks by a special tool set in the groove and struck with a hammer.

Figure 3:
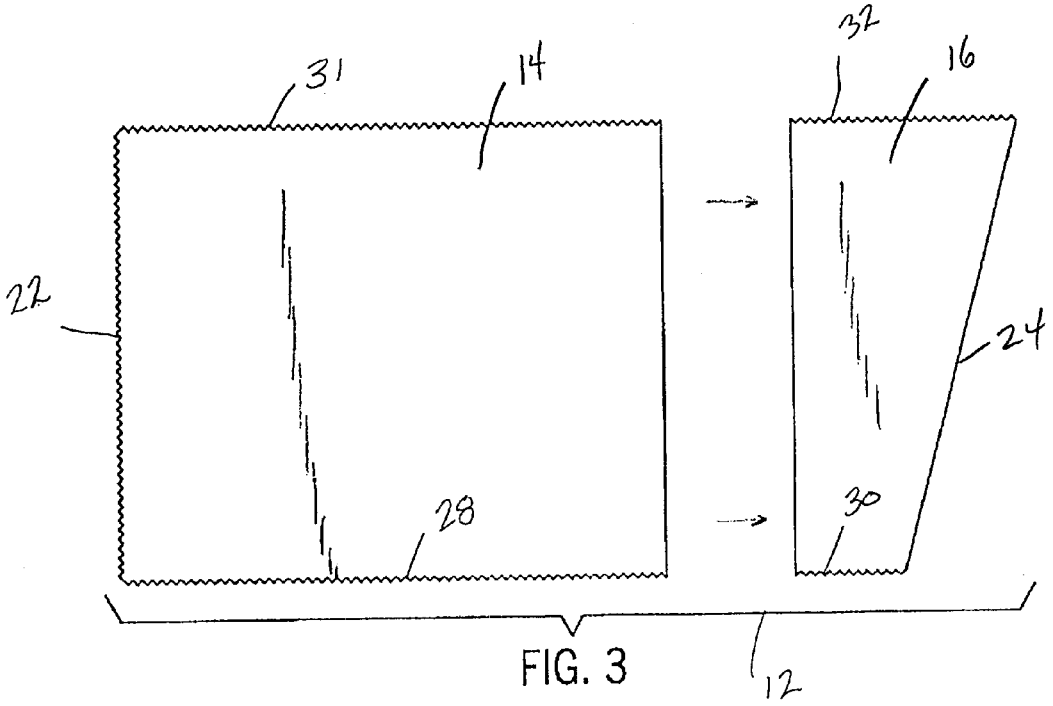
FIG. 3 is a top view illustrating the separation of the retaining wall block into a first sub-block and a second sub-block.
Figure 4:
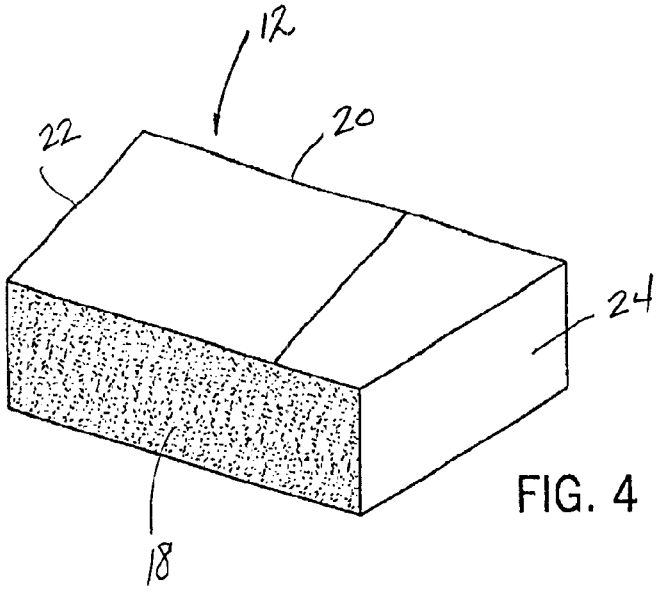
FIG. 4 is a perspective view illustrating the retaining wall block of the present invention.
Figure 5:
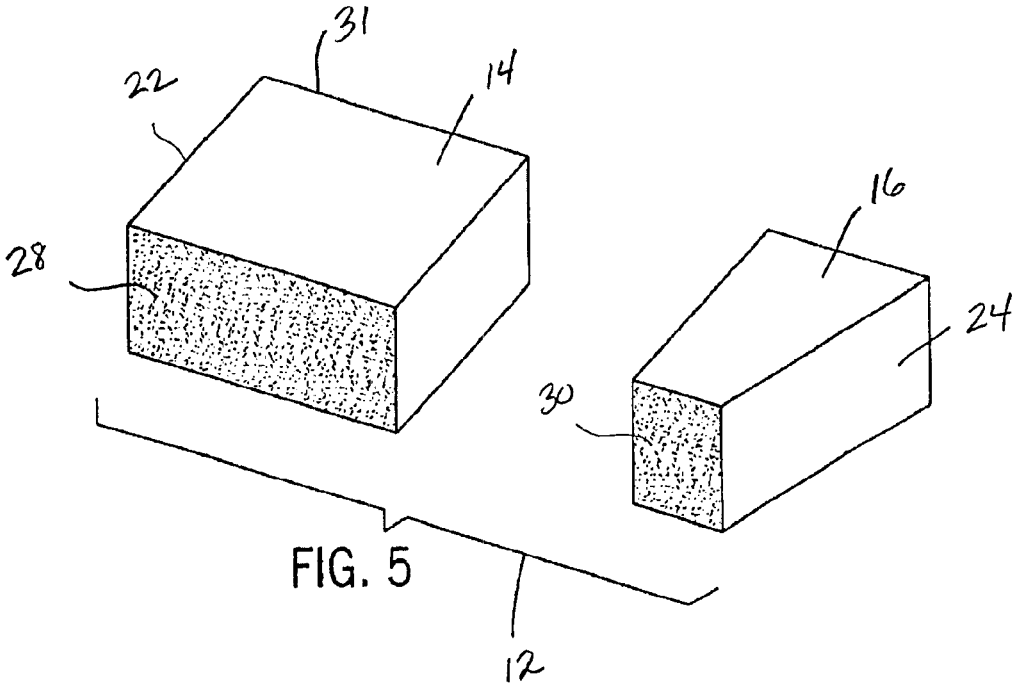
FIG. 5 is a perspective view illustrating the separation of the wall block into a first sub-block and a second sub-block that can be used to create the random retaining wall of FIG. 1.

Referring now to FIG. 3, when the retaining wall block 12 is struck along the scoring groove 26, the wall block 12 separates into the first sub-block 14 and the second sub-block 16. After the wall block 12 has been separated into the first sub-block 14 and the second sub-block 16, the two individual blocks can be used in forming the retaining wall 10 shown in FIG. 1.

Referring back to FIG. 3, when the wall block 12 is fractured, the first textured face surface 18 is divided into a fourth textured face surface 28 contained in the first sub-block 14 and a fifth textured face surface 30 contained on the second sub-block 16. Preferably, the fourth textured face surface 28 has a length of 8.75 inches and the fifth textured face surface 30 has a length of 2.75 inches.

After the wall block 12 has been separated into the first sub-block 14 and the second sub-block 16, the second textured face surface 20 is divided into a sixth textured face surface 31 and a seventh textured face surface 32. Since the scoring groove 26 is perpendicular to both the first textured face surface 18 and the second textured face surface 20, the fourth face surface 28 and the sixth face surface 31 formed on opposite sides of the first sub-block 14 have the same length. Although the fourth and sixth face surfaces have the same length, the pair of face surfaces allow the first sub-block 14 to be positioned such that the third face surface 22 faces outward in either direction to form either end of the retaining wall 10, as shown in FIG. 1. In the preferred embodiment of the invention, the seventh face surface 32 has a length of 4.75 inches, such that the sixth face surface 31 is eight inches in length.

Referring back to FIG. 1, the second sub-block 16 can be positioned such that either the fifth face surface 30 or the seventh face surface 32 faces outward, as illustrated. Likewise, the first sub-block 14 can be positioned such that either of the fourth face surface 28, the sixth face surface 31 or the third face surface 22 faces outward.

As can be understood by the above description, the single, main retaining wall block 12 can be utilized to create an outwardly facing surface having one of six distinct lengths, based upon whether the retaining wall block is utilized as a complete unit or is divided into two separate sub-blocks by fracturing the wall block 12 along a scoring groove 26. Since the separation of the wall block 12 into its two sub-blocks requires very little effort or tooling, the single retaining wall block 12 can be used to create the retaining wall 10 having a random appearance. By utilizing the retaining wall block 12 of the present invention, only a single type of block needs to be maintained in inventory, while allowing the flexibility of six distinct face surface lengths when forming the retaining wall 10. Therefore, the retaining wall block 12 of the present invention eliminates the need for multiple molds and a large inventory, while maintaining the flexibility of six different face surface lengths for creating a retaining wall having a random appearance.

In the above description, specific dimensions for the size and thickness of the retaining wall block are set forth for clarity. However, it should be understood that these dimensions are for illustrative purposes only and are not meant to limit the scope of the invention. The inventors contemplate the formation of blocks having a variety of sizes other than those set forth above.

Various alternatives and embodiments are contemplated as being within the scope of the following claims particularly pointing out and distinctly claiming the subject matter regarded as the invention.

I claim:

1. A retaining wall block for forming a retaining wall having a decorative appearance along an outwardly facing surface, comprising:

a first textured face surface having a first length;

a second textured face surface extending parallel to and spaced from the first textured face surface, the second textured face surface having a second length greater than the first length;

a third textured face surface extending between the first and second textured face surfaces, the third textured face surface having a third length different than both the first length and the second length, the first, second and third textured face surfaces being formed for inclusion in the formation of the outwardly facing surface of the retaining wall; and a scoring groove extending between the first textured face surface and the second textured face surface, wherein the retaining wall block can be separated into a first sub-block and a second sub-block by fracture along the scoring line such that the first sub-block and the second sub-block can both be used in forming the retaining wall;

wherein the first sub-block and the second sub-block together define at least three textured face surfaces having different lengths for inclusion in the formation of the outwardly facing surface of the retaining wall.

2. The retaining wall block of claim 1 wherein when the retaining wall block is separated into the first sub-block and the second sub-block, the first textured face surface is divided into a fourth textured face surface formed on the first sub-block and a fifth textured face surface is formed on the second sub-block.

3. The retaining wall block of claim 2 wherein when the retaining wall block is separated into the first sub-block and the second sub-block, the second textured face surface is divided such that a sixth textured face surface is formed on the first sub-block opposite the fourth textured face surface and a seventh textured face surface is formed on the second sub-block opposite the fifth textured face surface.

4. The retaining wall block of claim 3 wherein the length of the first, second, third, fourth, fifth and seventh face surfaces are different from each other.

5. The retaining wall block of claim 3 wherein the retaining wall block includes an angled side surface extending between the first textured face surface and the second textured face surface, wherein the angled side surface is contained on the second sub-block when the retaining wall block is separated.

6. The retaining wall block of claim 1 wherein the scoring groove is formed in a top face surface of the retaining wall block and is perpendicular to the first face surface and the second face surface.

7. The retaining wall block of claim 1 wherein the third textured face surface is perpendicular to both the first textured face surface and the second textured face surface.

8. A retaining wall block for forming a retaining wall having a decorative appearance along an outwardly facing surface, comprising:

a first textured face surface having a first length;

a second textured face surface extending parallel to and spaced from the first textured face surface, the second textured face surface having a second length greater than the first length;

a third textured face surface extending between the first textured face surface and the second textured face surface, the third textured face surface having a third length different than both the first length and the second length, the first, second and third textured face surfaces being formed for inclusion in the formation of the outwardly facing surface of the retaining wall;

an angled side surface extending between the first textured face surface and the second textured face surface; and a scoring groove extending between the first textured face surface and the second textured face surface, wherein the retaining wall block can be separated into a first sub-block and a second sub-block by fracture along the scoring line such that the first sub-block and the second sub-block can both be used in forming the retaining wall;

wherein when the retaining wall block is separated into the first sub-block and the second sub-block, the first sub-block and the second sub-block together define at least three outer textured face surfaces having different lengths for inclusion in the formation of the outwardly facing surface of the retaining wall.

9. The retaining wall block of claim 8 wherein when the retaining wall block is separated into the first sub-block and the second sub-block, the first textured face surface is divided into a fourth textured face surface formed on the first sub-block and a fifth textured face surface is formed on the second sub-block.

10. The retaining wall block of claim 9 wherein when the retaining wall block is separated into the first sub-block and the second sub-block, the second textured face surface is divided such that a sixth textured face surface is formed on the first sub-block opposite the fourth textured face surface and a seventh textured face surface is formed on the second sub-block opposite the fifth textured face surface.

11. The retaining wall block of claim 10 wherein the length of the first, second, third, fourth, fifth and seventh face surfaces are different from each other.

12. The retaining wall block of claim 8 wherein the scoring groove is formed in a top face surface of the retaining wall block and is perpendicular to the first face surface and the second face surface.

* * * * *

UNITED STATES PATENT AND TRADEMARK OFFICE

CERTIFICATE OF CORRECTION

PATENT NO. : 6,431,798 B1 
DATED : August 13, 2002
INVENTOR(S) : Richard L. Magliocco It is certified that error appears in the above-identified patent and that said Letters Patent is hereby corrected as shown below:

Title page,
Item [73], Assignee, delete "Best Block Company" and substitute therefor -- Softsplit Technology, Inc. --

Signed and Sealed this

Twenty-sixth Day of November, 2002

*Attest:*

*Attesting Officer*

JAMES E. ROGAN
*Director of the United States Patent and Trademark Office*